United States Patent [19]

Crown

[11] Patent Number: 4,829,794

[45] Date of Patent: May 16, 1989

[54] PADLOCK

[75] Inventor: Marlin D. Crown, Sterling, Ill.

[73] Assignee: National Manufacturing Co., Sterling, Ill.

[21] Appl. No.: 191,867

[22] Filed: May 9, 1988

[51] Int. Cl.[4] ..... E05B 37/02

[52] U.S. Cl. ..... 70/25; 70/316

[58] Field of Search ..... 70/315, 316, 317, 318, 70/312, 25

[56] References Cited

U.S. PATENT DOCUMENTS

| | | | |
|---|---|---|---|
| 3,386,271 | 6/1968 | Morin | 70/25 |
| 3,592,027 | 7/1971 | Wako | 70/25 |
| 3,720,082 | 3/1973 | Feinberg | 70/25 |
| 3,766,758 | 10/1973 | Heine | 70/25 |
| 4,048,821 | 9/1977 | Bako | 70/25 |
| 4,341,099 | 7/1982 | Garro | 70/25 |
| 4,444,029 | 4/1984 | Remington | 70/25 |
| 4,733,548 | 3/1988 | Ling | 70/25 |

*Primary Examiner*—Robert L. Wolfe

*Attorney, Agent, or Firm*—Edmond T. Patnaude

[57] ABSTRACT

The present invention relates in general to combination padlocks of the type which permit the user to reset the combination, and it relates in particular to a new and improved mechanism for preventing spurious or unintentional changing of the combination.

5 Claims, 3 Drawing Sheets

PADLOCK

BACKGROUND OF THE INVENTION

Combination padlocks which permit changing of the combination without disassembling the padlock or without using special tools have been on the market for many years. U.S. Pat. No. 3,720,082 discloses one such padlock. It includes a mechanism which requires the shackle to be located in a predetermined angular position and then to be pushed in an inward direction to permit changing of the combination. U.S. Pat. No. 3,386,271 discloses another combination padlock including a mechanism for resetting the combination. In order to reset the combination a slide is pressed into the body to unblock the shackle so as to permit it to be pulled outwardly to a position where the positions of the lock tumblers can be changed.

SUMMARY OF THE INVENTION

Briefly, there is provided in accordance with the present invention a new and improved padlock construction wherein the combination can be reset by rotating the open shackle to a predetermined position and then simply pulling the shackle outwardly. Inadvertent changing of the combination is prevented by means of a spring detent, a gate and an eccentric lug on one leg of the shackle. In order to change the combination, the force of the spring must be overcome before the shackle can be pulled outwardly to the position where the tumblers are released from the associated dials.

GENERAL DESCRIPTION OF THE DRAWINGS

The present invention will be better understood by a reading of the following detailed description taken in connection with the accompanying drawing wherein:

FIG. 1 is a side elevational view of a padlock embodying the present invention;

FIG. 2 a longitudinal cross-sectional view of the padlock of FIG. 1, the padlock being show in the closed or locked position;

DETAILED DESCRIPTION OF A PREFERRED EMBODIMENT

Figure 1:
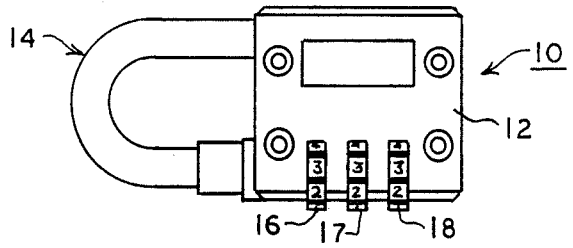
Figure 3:
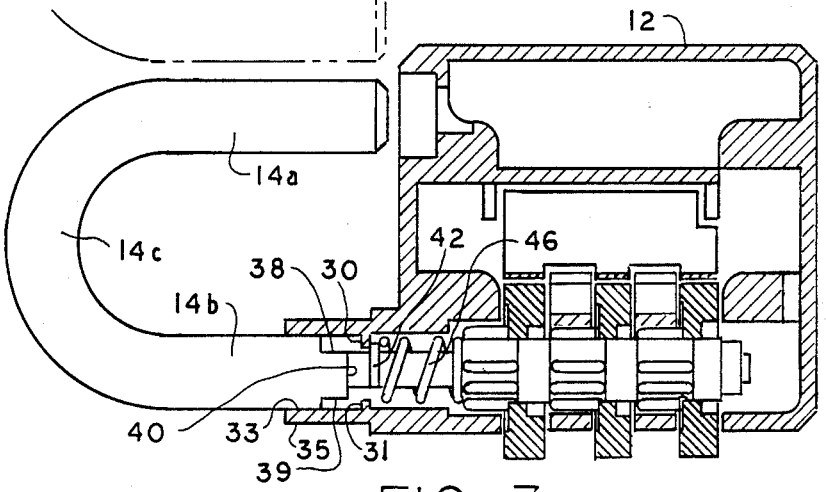
FIG. 3 is a view similar to that of FIG. 2, but in this view the padlock is shown in the open or unlocked position.

Referring to FIG. 1, there is shown a padlock 10 having a body 12, a shackle 14 and a pluality of dial wheels 16, 17 and 18. When the dial wheels are set to the proper combination, the shackle 14 can be pulled partially out of the body to an open position as shown in FIG. 3. When the dial wheels are in any other position, the shackle cannot be pulled out from the body to unlock the padlock.

Figure 2:
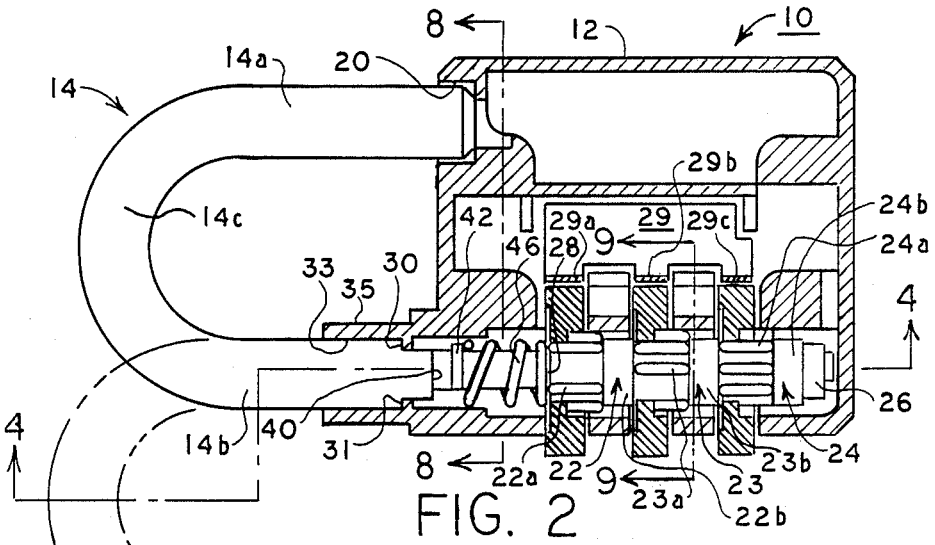

As best shown in FIGS. 2 and 3, the shackle 14 has a short leg **14*a* and a long leg 14*b* connected together by a U-shaped section 14*c*. The body 12 is provided with a cylindrical recess 20 which receives the distal end portion of the short leg 14*a* when the shackle is in the closed or locked condition as shown in FIG. 2**.

A plurality of tumbler sleeves 22, 23 and 24 are rotatably mounted in end-to-end relationship on the long leg **14*b* between a stop ring 26 fitted in an annular groove near the distal end of the long leg 14*b* and an annular shoulder 28 on the long leg 14*b*. The sleeves 22, 23 and 24 are independently rotatable on the leg 14*b* by means of the dial wheels 16, 17 and 18** during normal operation of the padlock, i.e., except when the padlock is in the combination setting condition. When the padlock is in the latter operating condition the dial wheels are freely rotatable relative to the tumbler sleeves.

Figure 6:
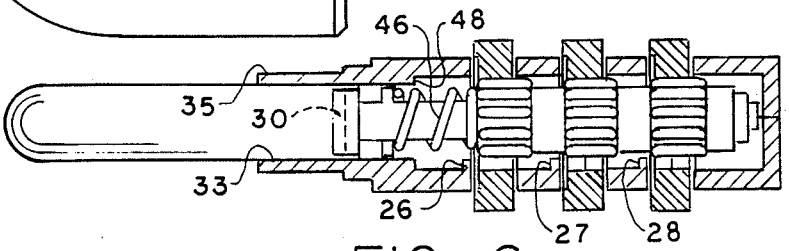
FIG. 6 is a cross-sectional view taken along the line 4—4 of FIG. 2, showing the shackle in the fully closed position.
Figure 7:
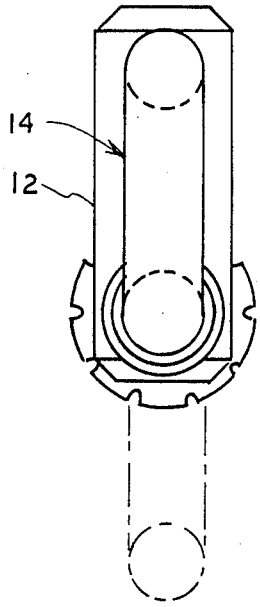
FIG. 7 is an elevational view taken from the left side of FIG. 2.
Figure 8:
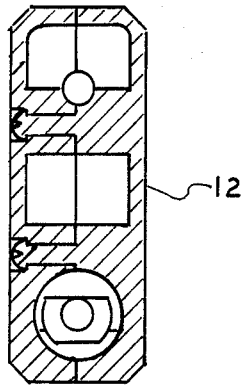
FIG. 8 is a cross-sectional view of the body of the padlock taken along the line 8—8 of FIG. 2.
Figure 10:
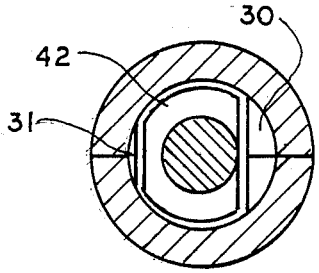
FIG. 10 is a cross-sectional view taken along the line 10—10 of FIG. 4.
Figure 9:
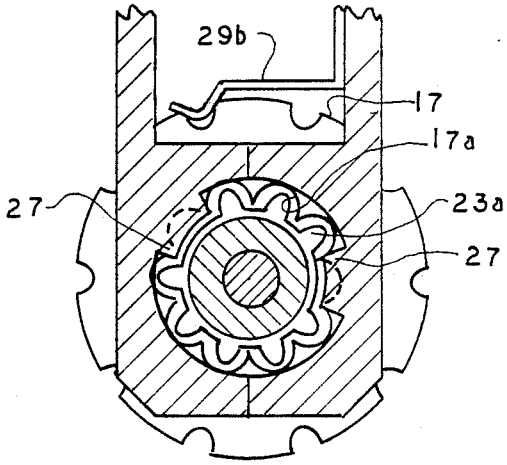
FIG. 9 is a partial cross-sectional view taken along the line 9—9 of FIG. 2.

The tumbler sleeves 22, 23 and 24 are identical and respectively include a plurality of longitudinal ribs **22*a*, 23*a* and 24*a* which extend from one end of the associated sleeve for about two-thirds the length of the sleeve leaving non-ribbed sections 22*b*, 23*b* and 24*b* for the remainder of the sleeves. The ribs 22*a*, 23*a* and 24*a* are spaced equally about the circumference of the associated sleeve, but as best shown in FIG. 9 two of the ribs are omitted from each of the sleeves. Three pairs of longitudinally aligned blocking lugs 26 and 26', 27 and 27', 28 and 28' are integral parts of the body 12 and respectively engage one of the ribs on the tumbler sleeves unless the spaces for the omitted ribs are aligned with the blocking lugs as shown in FIGS. 6 and 9**.

In order to selectively rotate the tumbler sleeves on the leg **14*b*, the dial wheels are provided with equally spaced internal grooves 16*a*, 17*a* and 18*a* which respectively receive the ribs 22*a*, 23*a* and 24*a* when the shackle 14 is in the locked or unlocked position as shown in FIGS. 2 and 3. A leaf spring 29 is mounted in the body 12 and includes three spring fingers 29*a*, 29*b* and 29*c* which respectively press against the dial wheels 16, 17 and 18 to prevent spurious rotation thereof. As more fully described below, when the shackle is pulled outwardly to the combination changing position shown in FIG. 5, the non-ribbed sections 22*b*, 23*b* and 24*b* are aligned with the grooved sections of the dial wheels to permit relative rotation between the dial wheels and the tumbler sleeves. When the shackle is in the combination changing position the sleeves are prevented from rotating by the lugs 26, 27 and 28 which at that time are in the positions illustrated in FIG. 9** between the lugs on the two sides of the omitted-lug space.

In order to prevent spurious changing of the combination, a pair of gate lugs 30 and 31 extend a short distance into the bore 33 in a tubular extension 35 of the body 12. As best shown in FIGS. 2 and 3, the gate lug 30 extends farther into the bore 33 than does the gate lug 31. The shackle leg **14*b* is provided with a pair of flats 38 and 39 which are eccentrically located relative to the longitudinal axis of the shackle so that when the shackle 14 is in the position shown in FIGS. 2 and 3 the flats can pass into the space between the gate lugs 30 and 31. However, in any other angular position of the shackle 14 the shackle cannot be pushed into the body 12 because at least one of the shoulders 40 will abut the gate lugs. Inasmuch as the flats 39 are eccentric, i.e., the shoulder 40 on one side has a shorter radial dimension than the other, the shackle cannot be pushed into the body 12** except when it is in the angular position for locking.

Figure 4:
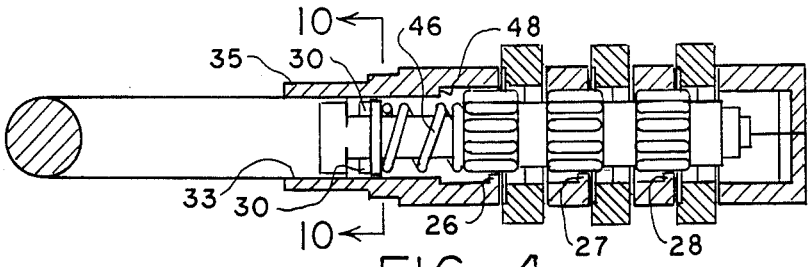
FIG. 4 is a cross-sectional view taken along the line 4—4 of FIG. 2, the shackle being in the angular position for moving to the combination setting position and partially extended from the of the padlock.

Spaced from the shoulders 40 is an integral stop lug 42 which abuts the gate lug 31 when the shackle is in the open position as illustrated in FIG. 3. When, however, the shackle is rotated 180 degrees from the unlocked or open position, the top lug 42 will pass outwardly through the space between the gate lugs 30 and 31 to permit outward movement of the long shackle leg **14*b* to the combination changing postiion shown in FIG. 4**.

Figure 5:
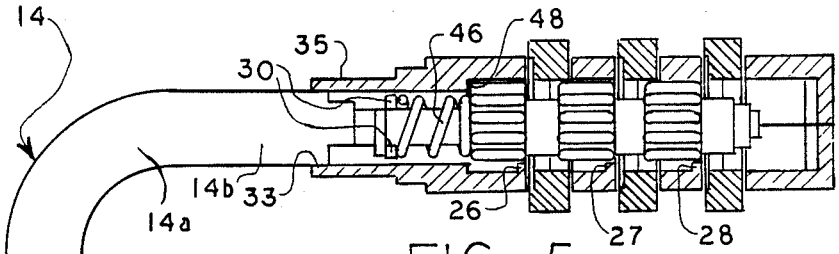
FIG. 5 is a cross-sectional view similar to that of FIG. 4, but showing the shackle fully extended and in an angular position resetting the combination.

When the shackle is pulled outwardly to the combination changing position shown in FIG. 5, the ribs **22*a*, 23*a* and 24*a* are disengaged from the internal lugs on the dial wheels which may then be rotated to different positions for setting a new combination. Then when the leg 14*b* is moved back into the body 12** the dial wheels are reengaged by the tumbler sleeves and are rotated in unison therewith.

In order to prevent the spurious movement of the shackle 14 into the extended combination changing position, a coil spring 46 is disposed over the leg **14*b* between the end face 28 of tumbler sleeve 22 and the lug 42. When the shackle 14 is 180 degrees from the locked position, as the shackle 14 is pulled out of the body the outer end of the spring 46 abuts the gate lugs 30 and 31 and must therefore be compressed as the shackle leg 14*b* and the tumbler sleeves are withdrawn to the combination changing position wherein the outer end of the sleeve 22*a* abuts an internal annular shoulder 48 in the body 12. The force required to compress the spring 46 thus provides a detent action which holds the shackle 14*b*** and the tumbler sleeves out of the combination changing position.

While the present invention has been described in connection with a particular embodiment thereof, it will be understood by those skilled in the art that many changes and modifications may be made without departing from the true spirit and scope of the present invention. Therefore, it is intended by the appended claims to cove all such changes and modifications which come within the true spirit and scope of this invention.

What is claimed:

1. A combination padlock comprising a body having an internal cavity and a plurality of slots in communication with said cavity, a plurality of dials respectively positioned in said slots, a shackle having a long leg and a short leg, said long leg extending through an opening in said body into said cavity, said shackle being movable between a first open position wherein the distal end of said short leg is withdrawn from said body, a second closed position wherein said distal end of said short leg extends into said body, and a third combination setting position wherein said shackle is withdrawn a greater distance from said body than when said shackle is in said first open position, a plurality of sleeves rotatably mounted in said cavity in end to end abutting relationship on said long leg, means keying each of said dials to a respective one of said sleeves, coil spring means mounted on said long leg with one end in engagement with an end on one of said sleeves, an abutment in said body in engagement with the other end of said coil spring means for holding said spring in compressed relationship against said one of said sleeves, means provided on said long leg for preventing linear movement of said sleeves on said long leg, interlocking means for locking said dials and said sleeves in mutually non rotatable conditions when said shackle is in said first and second position and for permitting relative rotation between said dials and said sleeves when said shackle is in said third position, first blocking means on said body, second blocking means on said shackle cooperable with said first blocking means for preventing movement of said long leg outwardly of said body from said second position to said third position when said long leg is in other than a single angle of orientation relative to said body, and a plurality of third blocking means on said body cooperable with a plurality of fourth blocking means on said sleeves for preventing movement of said shackle from said first position to said second position other than when said sleeves are each in a predetermined angular position.

2. A combination padlock according to claim 1, wherein said second blocking means comprises an eccentric shoulder o said shackle.

3. A combination padlock according to claim 2, comprising an integral tubular portion extending from said body through which said long leg extends, said first blocking means being disposed within said tubular portion.

4. A combination padlock according to claim 3, wherein said coil spring means is held in compression between said eccentric shoulder and said end one of said sleeves.

5. A combination padlock according to claim 1, wherein said body comprises first and second mating parts affixed together, and said first blocking means comprises lugs extending from said first and said second mating parts into said cavity.

* * * * *